United States Patent [19]

McDonald

[11] 4,375,142

[45] Mar. 1, 1983

[54] GUARD FOR ISOLATING RECESSED CEILING LIGHTS FROM COMBUSTIBLE INSULATION

[76] Inventor: Gerald L. McDonald, 2706 Blaine Dr., Chevy Chase, Md. 20015

[21] Appl. No.: 886,467

[22] Filed: Mar. 14, 1978

[51] Int. Cl.[3] ..... E04F 19/02

[52] U.S. Cl. ..... 52/28; 52/221

[58] Field of Search ..... 362/147, 148, 376; 29/455 LM, 512; 52/28, 254, 631, 255, 108, 256, 221, 219, 577, 808

[56] References Cited

U.S. PATENT DOCUMENTS

| | | | |
|---|---|---|---|
| 2,220,898 | 11/1940 | Franklin | 52/631 X |
| 2,717,955 | 9/1955 | Schuemmer et al. | 362/148 |
| 2,998,511 | 8/1961 | Chan | 362/147 |
| 3,036,672 | 5/1962 | Kohl | 52/508 |
| 3,121,259 | 2/1964 | Versen | 52/28 |
| 3,290,066 | 12/1966 | Primich et al. | 29/512 X |
| 3,327,984 | 6/1967 | Rennie | 52/28 X |
| 3,348,465 | 10/1967 | Kruger | 362/147 |
| 3,440,331 | 4/1969 | Cohen | 52/28 X |
| 3,683,738 | 8/1972 | Kyriakos | 16/16 X |
| 3,714,744 | 2/1973 | Koziarz | 52/28 |
| 3,729,874 | 5/1973 | Albany | 52/75 X |
| 3,755,667 | 8/1973 | Price | 52/28 X |
| 3,848,897 | 11/1974 | McClellan | 52/219 X |
| 4,051,786 | 10/1977 | Nordgren | 403/230 X |

FOREIGN PATENT DOCUMENTS

| | | | |
|---|---|---|---|
| 798240 | 11/1968 | Canada | 52/577 |
| 860286 | 1/1941 | France | 52/577 |
| 603110 | 6/1948 | United Kingdom | 362/147 |

OTHER PUBLICATIONS

"Insul-Can", Insul-Can Company, Feb. 1978, 4 pages.
"Insl-Dam", T.N.L. Inc., 1 page, Jan. 19, 1979.

*Primary Examiner*—Rodney H. Bonck
*Attorney, Agent, or Firm*—B. P. Fishburne, Jr.

[57] ABSTRACT

Thin gage pre-creased and pre-punched sheet aluminum is cut to length from a supply roll on the job site where light fixtures are recessed in a ceiling containing combustible insulating material. The thin sheet metal is readily formed into a guard or dam of the necessary size and shape and placed around the recessed light fixture to prevent the insulation material from coming into contact therewith. Bendable tabs along one edge of the sheet material form bottom anchoring elements on the guard which can be stapled to the ceiling structure. The guard or dam is held in its erected form by screws or other fasteners engaging in the pre-punched openings of the sheet material. The guard is open from top to bottom and a generous air space is provided between the side wall of the guard and the light fixture.

7 Claims, 7 Drawing Figures

FIG. 1
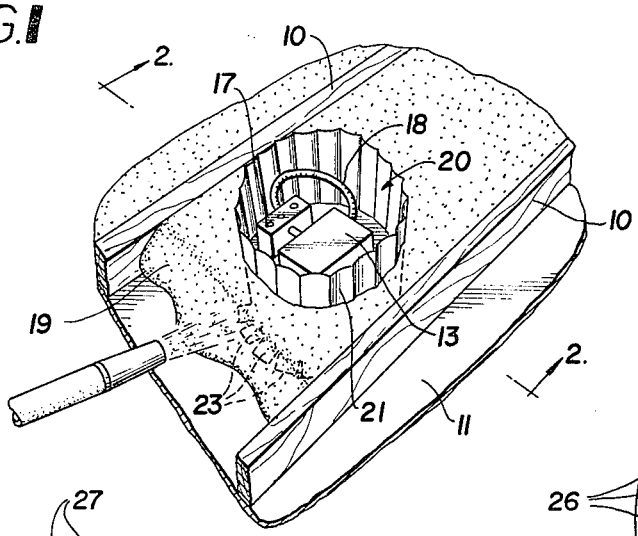
FIG. 3
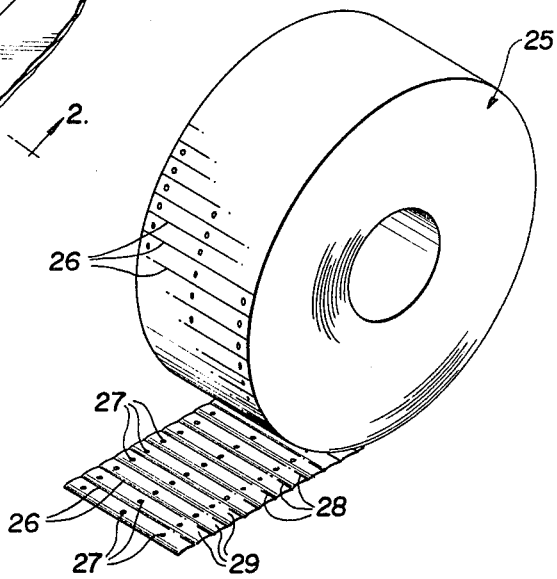
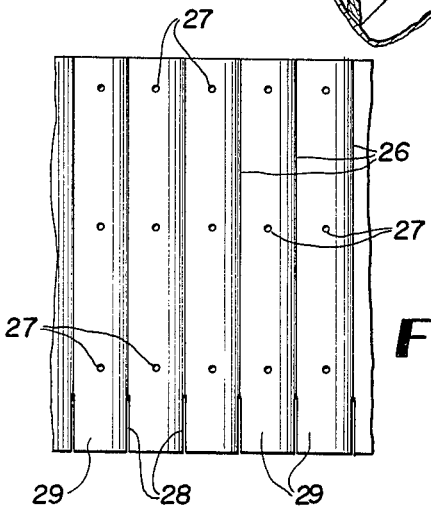
FIG. 4
FIG. 2
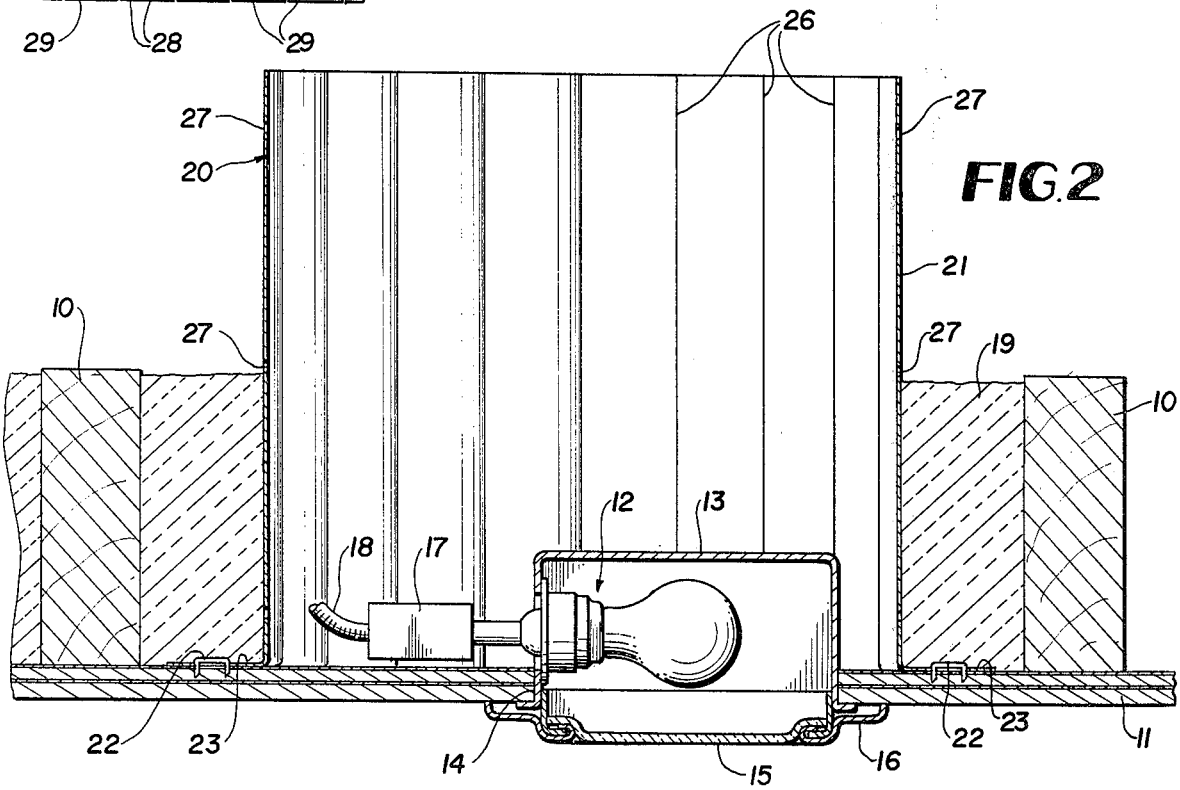

GUARD FOR ISOLATING RECESSED CEILING LIGHTS FROM COMBUSTIBLE INSULATION

BACKGROUND OF THE INVENTION

The current emphasis on home insulation resulting from the world energy shortage has created some safety hazards resulting from ill-advised practices. One of these hazards which has already resulted in some costly fires has arisen where loose insulating material has been introduced into ceilings and allowed to come into direct contact with recessed light fixtures which become very hot during operation. Because some insulating materials are combustible, ceiling fires have resulted from the above practice.

In light of the safety problem involving recessed light fixtures in insulated ceilings, this invention seeks to eliminate the described safety hazard completely through the use of an extremely economical and convenient device in the nature of a guard or dam surrounding recessed light fixtures and holding back and preventing adjacent insulating material from coming into contact with the fixture or its accessory parts.

The guard or dam, which can be quickly constructed and installed on the job site, is formed from a section of very thin gage sheet aluminum which is preferably pre-creased for easy shaping and bending by the installer and also pre-punched and pre-slit to facilitate erecting with a few sheet metal screws and anchoring to the top of the ceiling by bent tabs which can be stapled down. The installed guard or dam is open from top to bottom and has its side wall spaced from the recessed light fixture to form an unobstructed cooling or ventilating space around the fixture. The height of the guard above the ceiling is in excess of the maximum depth of insulating material which would ever be installed under accepted standards. Preferably, one side of the sheet aluminum is coated to resist the corrosive effects of some insulating materials.

Nothing in the known prior art possesses the capability and advantages of the invention including the extremely economical and very simplified construction of the device and its convenience of installation by relatively unskilled labor.

To comply with the duty to disclose known prior art under 37 C.F.R. 1.56, the following prior United States patents are made of record herein:

U.S. Pat. Nos. 2,717,955, 2,998,511, 3,121,259, 3,348,465, 3,440,331, 3,714,744, 3,755,667 and 3,848,897.

Various features and advantages of the invention over the prior art will become apparent during the course of the following detailed description.

BRIEF DESCRIPTION OF THE DRAWINGS

FIG. 1 is a fragmentary perspective view of an insulated ceiling having the invention installed in surrounding relationship to a recessed light fixture.

FIG. 2 is an enlarged vertical section through the invention taken on line 2—2 of FIG. 1.

FIG. 3 is a perspective view showing a supply roll of the material from which the invention is constructed.

FIG. 4 is an enlarged fragmentary plan view of a small section of the material.

DETAILED DESCRIPTION

Figure 5:
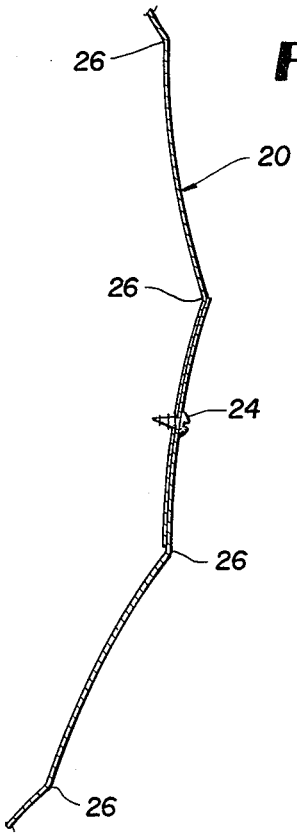
FIG. 5 is an enlarged fragmentary horizontal section through the guard or dam of FIGS. 1 and 2.

Referring to the drawings in detail wherein like numerals designate like parts, a section of a typical ceiling is illustrated in FIGS. 1 and 2 including spaced joists 10 and underlying plasterboard 11, or other suitable finishing material. A conventional light fixture 12 including a metal housing 13 is recessed into the ceiling by passing through an opening 14 cut through the plasterboard 11. A lens 15 and finishing frame 16 are provided in the usual manner immediately below the finished surface of the ceiling. The construction and mounting of the light fixture 12 is conventional and need not be further described. A junction box 17 and cable 18 for the light fixture are also arranged in the ceiling above the plasterboard 11 and between the joists 10.

While a single recessed light fixture only is illustrated in the drawings for simplicity, it will be appreciated that in practice any number of light fixtures may be present in a given ceiling and one unit of the present invention will be utilized in the manner shown and to be described with each recessed fixture.

FIGS. 1 and 2 show loose insulating material 19 filling the spaces between joists 10 and above the plasterboard 11 up to a desirable depth, such as six inches more or less. The depth of insulation will vary in practice, and the invention is designed to meet the needs resulting from various depths of insulation up to the maximum conceivable depth or level.

The invention proper, as started, is a dam or guard 20 whose purpose is to hold back the insulating material 19 which may be combustible and prevent it from coming into contact with any part of the light fixture 12 where the heat created by operation of the fixture could ignite the insulating material.

The guard consists of a vertical sleeve body 21, completely open from top to bottom and formed of very thin gage sheet aluminum, such as 0.011 inch thick aluminum. Preferably, the outer side of the guard 20 is coated with vinyl or other corrosion-resisting paint to resist the corrosive action of some insulation. "Anodized" aluminum may also be employed.

The height of the sleeve body 21 above the ceiling board 11 is preferably 12 inches and this height may be varied somewhat in practice. The guard or dam can be formed into a roughly cylindrical shape, FIG. 1, and is of such diameter or width to surround the light fixture 12 and its adjacent components with a space of at least 3 inches between the fixture and the guard 20. This provides a generous ventilating and cooling open top chamber around the fixture which is in communication with the attic space above.

The guard or dam 20 is anchored at its lower end to the ceiling board 11 or any other adjacent structure by means of staples 22 or like means applied through horizontal tabs 23 integrally formed on the bottom of the sleeve body 21 at right angles thereto and in circumferentially spaced relationship around the sleeve body.

Adjacent end portions of the material from which the guard 20 is constructed are lapped as illustrated in FIG. 5 and secured by sheet metal screws 24 engaging through pre-punched apertures in the material, as will be further described.

Preferably, although not necessarily, the guard or dam 20 which is constructed and installed on the job site is taken from a supply roll 25 of the thin gauge sheet aluminum which has been pre-coated on one side with the described corrosion-resisting material. The sheet or strip aluminum in the supply roll 25 is also preferably pre-creased transversely at 26 on approximately 2 inch centers to facilitate bending and shaping the material when constructing the guard 20. Midway between each transverse crease 26, the material has preferably three punched apertures 27 to receive the erecting screws 24 on the job site. These apertures and screws are disposed near the top, bottom and center of the erected guard for security. The lower edge portion of the material in the roll 25 is slit to a uniform depth as at 28 to provide between the slits approximately square integral tabs 29 which are readily bendable by hand to produce the horizontal anchoring elements 23, previously described. While a multiplicity of the tabs 23 are formed by bending on each guard, it is usually sufficient to apply the staples 22 through only a few of the tabs around the circumference of the guard or dam.

Figure 6:
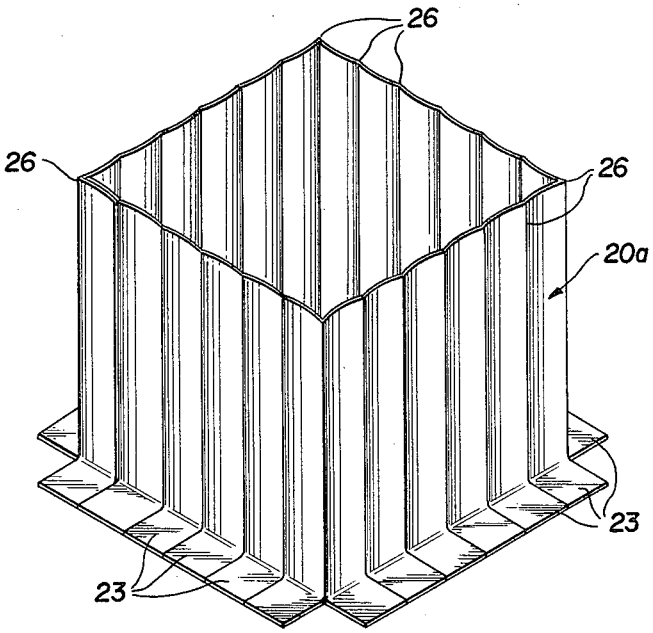
FIGS. 6 and 7 are perspective views of guards according to the invention which are modified as to size and shape.

FIG. 6 illustrates a variation in the shape of the guard **20*a* formed in accordance with the invention. In some instances, it may be more convenient and more efficient to produce a rectangular guard around a given recessed fixture and this capability of the invention is illustrated. The identical strip material from the supply roll 25 is utilized to produce the rectangular guard 20*a*. The shape can be produced readily by bending the thin material only along four spaced creases 26, as illustrated. The bottom anchoring tabs 23 are formed manually as in the prior embodiment by simply bending the tabs 23** at right angles to the body of the guard.

Figure 7:
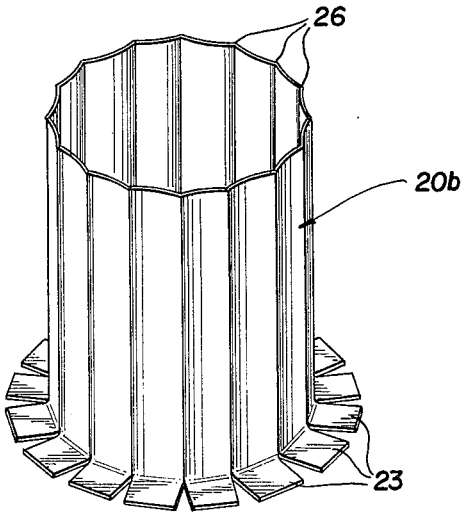

Another shape and size variation for a guard **20*b* formed of the same material on the supply roll 25 is shown in FIG. 7. The guard 20*b* is roughly cylindrical but is much smaller in diameter than the guard 20 in FIGS. 1 and 2. Where small light fixtures are encountered, the sheet aluminum used to form the guard can be minimized as illustrated in FIG. 7**. In this respect, the invention possesses a high degree of versatility and the guards can be custom shaped by a comparatively unskilled installer.

It is desired to emphasize that the manufacturing and installation cost of the invention is extremely minimal thus making it feasible to include the safety guard or dam in all insulated ceilings without significantly increasing the cost to the homeowner and with the great advantage of completely eliminating the hazard of fire resulting from ignited insulation. The advantages of the invention are many and should be recognized readily by those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A guard for placement in surrounding relationship to a recessed light fixture in an insulated ceiling comprising a substantially vertical sleeve body formed of thin gauge sheet metal of sufficient height to extend well above the maximum depth of insulation in a ceiling, said sheet metal being coated on at least the outer side of the sleeve body, the sleeve body being open at its top and defining a cooling and ventilating chamber around the recessed light fixture, and an anchoring element on the lower end of the sleeve body projecting approximately perpendicular to the axis of the sleeve body and adapted for stapling to a ceiling structure, said sheet metal being pre-creased transversely at a plurality of equidistantly spaced points for ready formability, said anchoring element comprising a plurality of circumferentially spaced tabs between pre-cut slits in one edge of the metal sheet at each crease, and fasteners securing said sheet into said sleeve body.

2. A guard as defined in claim 1, wherein end portions of the sheet material forming said guard are overlapped in the erected guard with apertures in the overlapped portions between creases being in registration and receiving said fastener elements therethrough which hold the guard in its erected condition.

3. A guard as defined in claim 1 in which said sleeve body is roughly cylindrical.

4. A guard as defined in claim 1 in which said sleeve body is roughly rectangular in horizontal cross section.

5. A guard as defined in claim 1, wherein said sheet metal has a thickness of approximately 0.011 inch.

6. A guard as defined in claim 1, wherein said anchoring element comprises a plurality of individual readily bendable tabs which may selectively be stapled to an underlying ceiling structure.

7. A guard as defined in claim 6, and said guard formed from a single unitary section of said thin gage sheet metal of uniform width and said bendable tabs are provided in every space between adjacent creases.

* * * * *